US009871605B2

(12) United States Patent
Christian

(10) Patent No.: US 9,871,605 B2
(45) Date of Patent: Jan. 16, 2018

(54) SELF-CONTAINED TACTICAL AUDIO DISTRIBUTION DEVICE

(71) Applicant: Science Applications International Corporation, McLean, VA (US)

(72) Inventor: James M. Christian, Tampa, FL (US)

(73) Assignee: Science Applications International Corporation, McLean, VA (US)

( * ) Notice: Subject to any disclaimer, the term of this patent is extended or adjusted under 35 U.S.C. 154(b) by 0 days.

(21) Appl. No.: 15/148,455

(22) Filed: May 6, 2016

(65) Prior Publication Data

US 2017/0324493 A1 Nov. 9, 2017

(51) Int. Cl.

| | |
|---|---|
| ***H04H 60/05*** | (2008.01) |
| ***H04R 3/04*** | (2006.01) |
| ***H04R 3/00*** | (2006.01) |
| ***H04R 3/12*** | (2006.01) |

(52) U.S. Cl.

CPC ..... *H04H 60/05* (2013.01); *H04R 3/005* (2013.01); *H04R 3/04* (2013.01); *H04R 3/12* (2013.01)

(58) Field of Classification Search

CPC ..... H04H 60/05; H04R 3/005; H04R 3/04; H04R 3/12

See application file for complete search history.

(56) References Cited

U.S. PATENT DOCUMENTS

| | | | |
|---|---|---|---|
| 2,374,129 | A | 4/1945 | Pitkin, Jr. |
| 3,999,015 | A | 12/1976 | Snyder et al. |
| 4,754,486 | A | 6/1988 | Stafford et al. |
| 4,941,187 | A | 7/1990 | Slater |
| 4,985,925 | A | 1/1991 | Langberg et al. |
| 5,243,659 | A | 9/1993 | Stafford et al. |
| 6,118,878 | A | 9/2000 | Jones |
| 6,278,786 | B1 | 8/2001 | McIntosh |

(Continued)

FOREIGN PATENT DOCUMENTS

| | | | |
|---|---|---|---|
| CA | 2283568 | A1 | 9/1998 |
| FR | 2780219 | A1 | 12/1999 |

(Continued)

OTHER PUBLICATIONS

Extron Electronics MDA 3 Series User Guide; downloaded prior to May 6, 2016.

(Continued)

*Primary Examiner* — Ping Lee

(74) *Attorney, Agent, or Firm* — Banner & Witcoff, Ltd.

(57) ABSTRACT

A tactical audio distribution device may include a housing. A plurality of connection jacks may be coupled to the housing. A plurality of microphone input signal connection points may be contained in the housing and may be in electrical communication with at least a portion of the connection jacks. At least one digital audio matrix processor may be contained in the housing. The at least one digital audio matrix processor may be configured to receive audio signals based on audio signals from microphones, to combine those signals into a mixed audio signal, and to output the mixed audio signal. A plurality of headphones output signal connection points may be contained in the housing and be in electrical communication with at least some of the connection jacks and may be configured to receive signals based on the mixed audio signal.

15 Claims, 11 Drawing Sheets

(56) References Cited

U.S. PATENT DOCUMENTS

| | | | | |
|---|---|---|---|---|
| 6,535,609 | B1 | 3/2003 | Finn et al. | |
| 7,068,798 | B2 | 6/2006 | Hugas et al. | |
| 7,489,785 | B2 | 2/2009 | Donaldson et al. | |
| 7,937,118 | B2 | 5/2011 | Coutinho et al. | |
| 8,625,775 | B2 | 1/2014 | Bhaskar et al. | |
| 9,190,043 | B2 | 11/2015 | Krisch et al. | |
| 9,288,570 | B2 | 3/2016 | Briggs et al. | |
| 2001/0053228 | A1 | 12/2001 | Jones | |
| 2003/0008627 | A1* | 1/2003 | Efron | G11B 27/031 455/143 |
| 2003/0053650 | A1 | 3/2003 | Wang | |
| 2005/0238179 | A1 | 10/2005 | Erdmann | |
| 2006/0183474 | A1 | 8/2006 | Liarno et al. | |
| 2007/0253569 | A1 | 11/2007 | Bose | |
| 2010/0000950 | A1* | 1/2010 | Malekmadani | A47B 96/024 211/26 |
| 2011/0194250 | A1 | 8/2011 | Perkins, III et al. | |
| 2012/0231787 | A1 | 9/2012 | Conner et al. | |
| 2014/0314241 | A1 | 10/2014 | Penhune | |
| 2015/0062831 | A1 | 3/2015 | Perkins, III et al. | |
| 2015/0104042 | A1* | 4/2015 | Ito | H04H 60/04 381/119 |
| 2015/0146891 | A1* | 5/2015 | Huber | H04H 60/04 381/119 |
| 2016/0055860 | A1 | 2/2016 | Rutherford | |

FOREIGN PATENT DOCUMENTS

| | | | |
|---|---|---|---|
| GB | 2032229 | A | 4/1980 |
| JP | S57124960 | A | 8/1982 |
| JP | S6058733 | A | 4/1985 |

OTHER PUBLICATIONS

Extron Electronics DMP 64 Digital Matrix Processor User Guide; downloaded prior to May 6, 2016.

Extron Electronics DMP 44 LC Four-Line Input and Four-Line Output Digital Matrix Processor User Guide; bears 2015 copyright date.

Extron Electronics DMP 44 LC Digital Matrix Processor Brochure; bears 2011 copyright date.

Extron Electronics DMP 64 ProDSP™ Digital Matrix Processor Brochure; downloaded prior to May 6, 2016.

FSR Audio Products Group SADA-4/6 Stereo Audio Distribution Amplifier Brochure; downloaded prior to May 6, 2016.

RDL® Model STD Divider/Combiner Networks Brochure.

Applicant Statement Regarding Prior Art.

Anderson, B. Wayne, et al., "Effects of Active Noise Reduction in Armor Crew Headsets," Audio Effectiveness in Aviation (1997): 15, Agard Conference Proceedings 596, <https://www.researchgate.net/profile/Anthony_Brammer/publication/44056249_Adaptive_active_noise_reduction_headset_for_helicopter_aircrew/links/551172b30cf29a3bb71ddaa8.pdf#pg=202>, 23 pages.

Steeneken, H.J., Potentials of Speech and Language Technology Systems for Military Use: An Application and Technology-Oriented Survey No. TNO-AC/243 (Panel 3)TR/21. Human Factors Research INST TNO Soesterberg (Netherlands), 1996, <http://www.dtic.mil/cgi-bin/GetTRDoc?AD=ADA314081>, Sep. 17, 1996, 69 pages.

Acker-Mills, Barbara E., et al., "Speech Intelligibility in Noise Using Throat and Acoustic Microphones." USAARL Report No. 2004-13, Aviation, space, and environmental medicine 77.1 (2006): 26-31, <http:/wwww.dtic.mil/cgi-bin/GetTRDoc?AD=ADA422522>, Apr. 2004, 23 pages.

"Analog Products selection guide: Audio System Architectures." Digi-Key, digikey.de, 2011, <http://www.digikey.de/Web%20Export/Supplier%20Content/NS_14/PDF/national_AnalogProducts.pdf#page=87>, 20 pages.

Guicking, Dieter, Patents on Active Control of Sound and Vibration: An Overview, D. Guicking, 2001, <http://www.quicking.de/dieter/Ov-oK16.pdf>, May 2009, 118 pages.

Notification of Transmittal of the International Search Report and the Written Opinion of the International Searching Authority, or the Declaration of PCT/US2017/031263 dated Jul. 19, 2017.

Applicant Supplemental Statement Regarding Prior Art, dated Oct. 6, 2017.

* cited by examiner

SELF-CONTAINED TACTICAL AUDIO DISTRIBUTION DEVICE

BACKGROUND

In some environments, ambient noise levels may be so high that normal conversation is difficult or impossible. Examples of such environments include various types of military aircraft. Although many aircraft may include an intercom system that can be used by pilots and other members of the flight crew, such systems are often unsuitable for use by personnel in the aircraft who may be performing other mission duties. Modifying existing aircraft intercom systems to accommodate communications by such other personnel would be expensive and impractical.

SUMMARY

This Summary is provided to introduce a selection of concepts in a simplified form that are further described below in the Detailed Description. This Summary is not intended to identify key features or essential features of the invention.

In some embodiments, a tactical audio distribution device may include a housing. A plurality of connection jacks may be coupled to the housing. A plurality of microphone input signal connection points may be contained in the housing and may be in electrical communication with at least a portion of the connection jacks. At least one digital audio matrix processor may be contained in the housing. The at least one digital audio matrix processor may be configured to receive audio signals based on audio signals from microphones, to combine those signals into a mixed audio signal, and to output the mixed audio signal. A plurality of headphones output signal connection points may be contained in the housing and be in electrical communication with at least some of the connection jacks and may be configured to receive signals based on the mixed audio signal.

Additional embodiments are described herein.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

Figure 1:
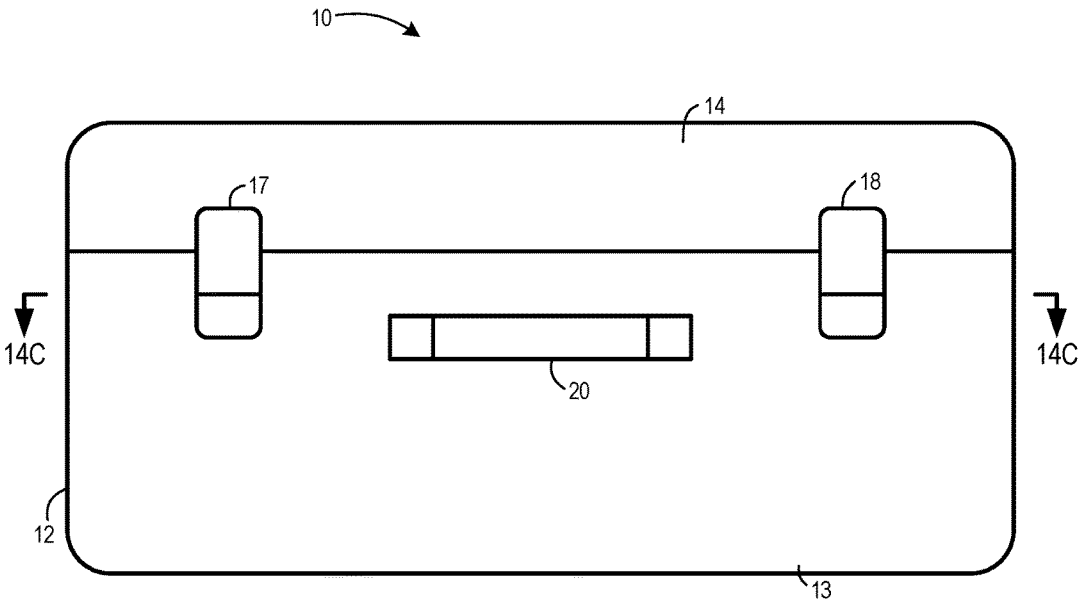
FIG. 1 is a front elevation view of a self-contained tactical audio distribution device according to at least some embodiments.

FIG. 1 is a front elevation view of a self-contained tactical audio distribution device 10 according to at least some embodiments. For convenience, tactical audio distribution device 10 will be referred to as "device 10" throughout the remainder of this description. As explained in more detail below, device 10 provides jacks to which multiple sets of microphones and headphones may be connected, as well as jacks for connection to an external conferencing system. Components within device 10 receive audio signal inputs from one or more of the microphone jacks and/or the conferencing system input jack, combine those audio signals into a mixed audio signal that includes audio components from all of the audio inputs, and output the mixed audio signal to one or more of the headphones jacks and/or the conferencing system output jack.

Figure 2:
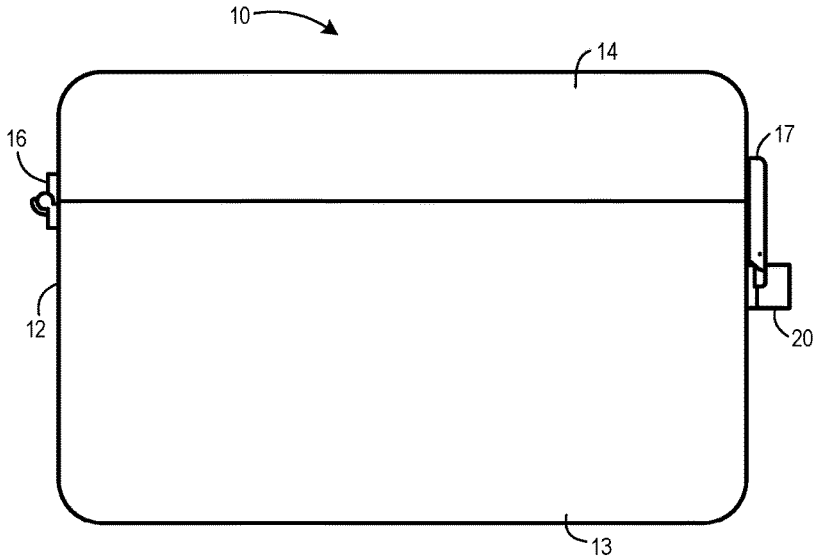
FIG. 2 is a right side elevation view of the tactical audio distribution device of FIG. 1.
Figure 3:
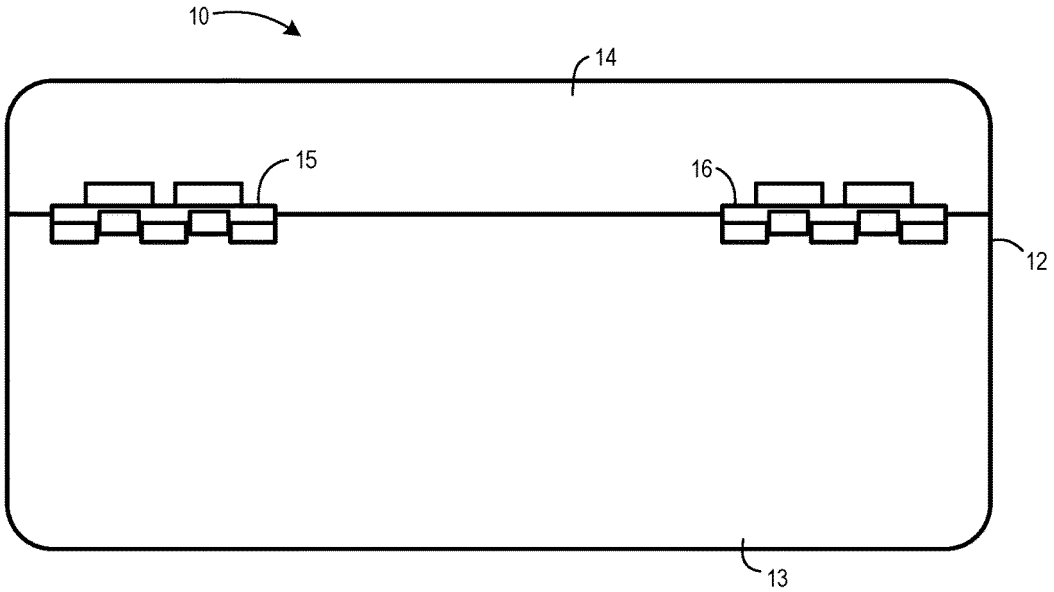
FIG. 3 is a rear view of the tactical audio distribution device of FIG. 1.
Figure 4:
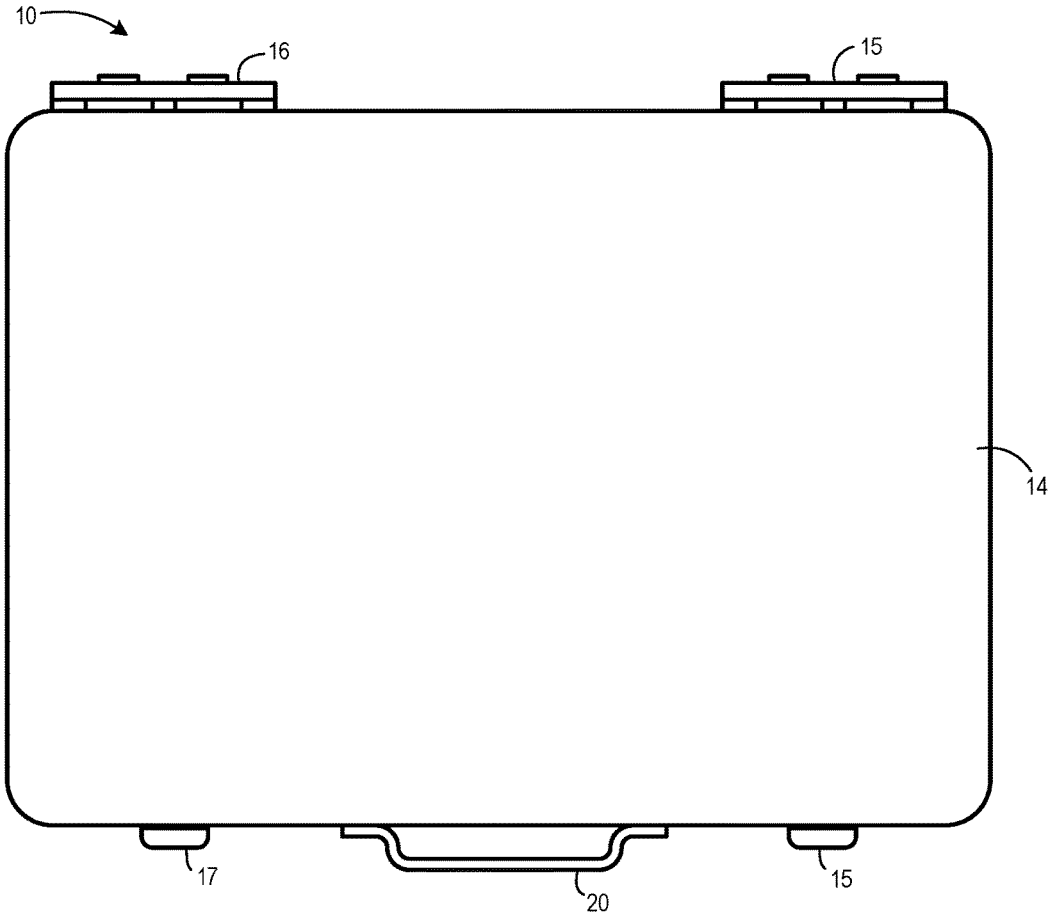
FIG. 4 is a top view of the tactical audio distribution device of FIG. 1.
Figure 5:
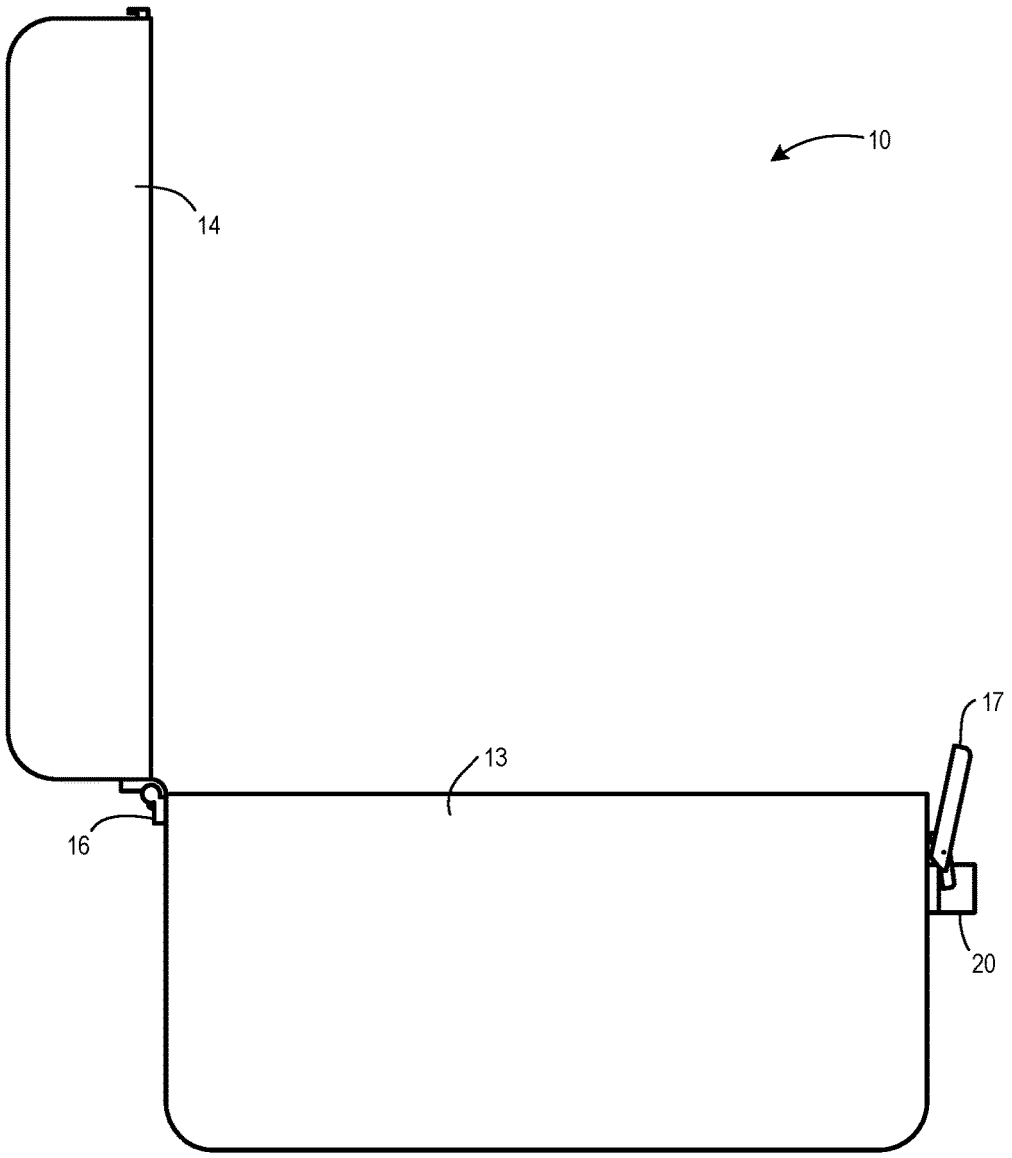
FIG. 5 is a right side elevation view of the tactical audio distribution device of FIG. 1 with the lid in an open condition.

FIG. 2 is a right side elevation view of device 10. A left side elevation view, not shown, would be a mirror image of FIG. 2. FIGS. 3 and 4 are rear elevation and top plan views, respectively, of device 10. Device 10 includes a housing 12 to contain and protect various components described below. Housing 12 includes a main body 13 and a lid 14. Main body 13 and lid 14 may be made of any suitable materials such as, without limitation, thermoset or thermoplastic polymers, reinforced thermoset or thermoplastic polymers, and/or one or more metals or metal alloys. Lid 14 is a hingedly attached to main body 13 by separable hinge assemblies 15 and 16. A pair of latches 17 and 18 secure lid 14 in the closed configuration shown in FIGS. 1-4 but can be released to allow opening of lid 14. FIG. 5 is another right side elevation view of device 10, but with latches 17 and 18 released and lid 14 rotated approximately 90°. A handle 20 is attached to the front side of housing 12.

Figure 6:
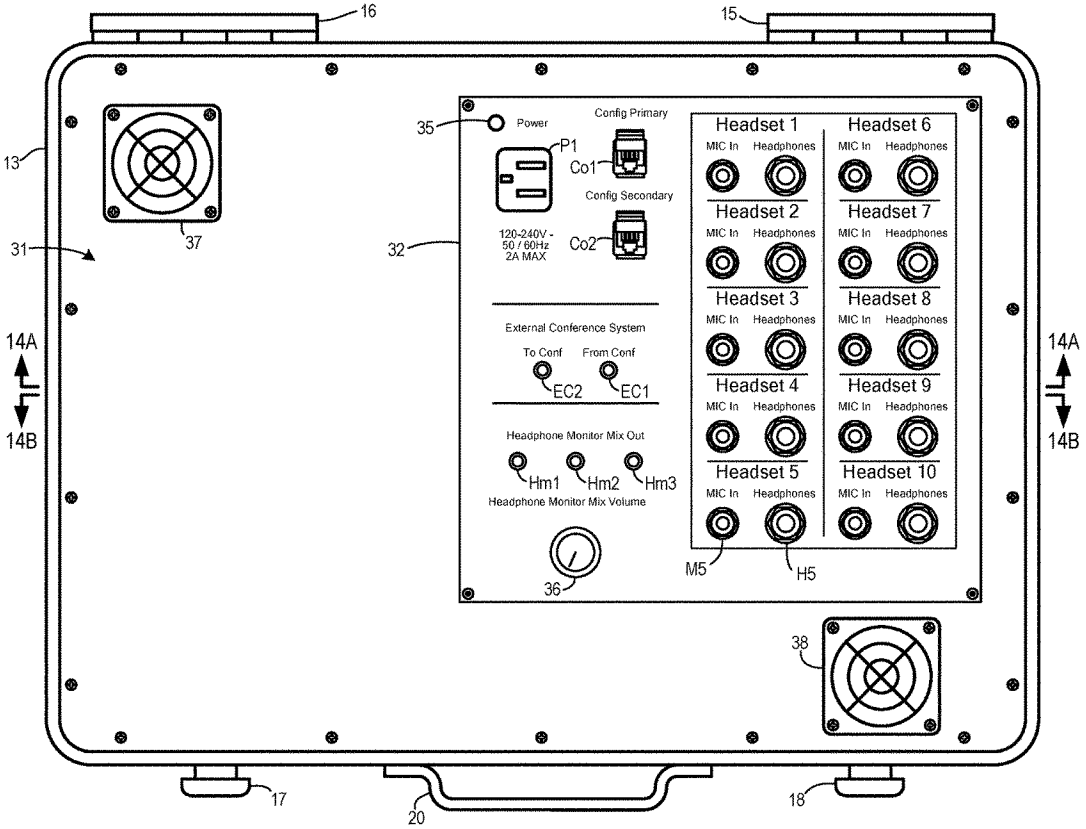
FIG. 6 is an enlarged top view of the tactical audio distribution device of FIG. 1 and with the lid removed.

FIG. 6 is an enlarged top view of device 10. In FIG. 6, lid 14 has been removed by releasing latches 17 and 18, opening lid 14, and lifting lid 14 so as to separate the top portions of hinges 15 and 16 (attached to lid 14) from the bottom portions of hinges 15 and 16 (attached to main body 13). Opening of lid 14 exposes an upper cover plate 31. Attached to cover plate 31 is a connection panel 32. The upper face of connection panel 32 is exposed in FIG. 6 and includes multiple jacks and other elements, as well as labeling for those jacks and other elements. An underside of connection panel 32 includes numerous signal connection points and wiring to electrically couple those signal connection points to the jacks.

Beginning on the left side of connection panel, an LED (light emitting diode) 35 labeled "Power" is positioned in the upper left corner. LED 35 is illuminated when device 10 is powered ON. Device 10 receives electrical power through a receptacle P1 labeled "120-240V-50/60 Hz 2A MAX." Receptacle P1 can be connected, using a conventional power cord, to an external source of electrical power meeting the requirements indicated on the receptacle P1 label. A power converter inside device 10 coverts the input power to a 12 VDC power supply for other components of device 10.

Located to the right of receptacle P1 are a first RJ-45 jack Co1 labeled "Config Primary" and a second RJ-45 jack Co2 labeled "Config Secondary." As explained in more detail below, jacks Co1 and Co2 can be used to provide configuration instructions to digital audio matrix processors in device 10.

Located below receptacle P1 and jacks Co1 and Co2 is a region of connection panel 32 labeled "External Conference System." Contained in that region are a jack EC1 labeled "From Conf" and a jack EC2 labeled "To Conf." As explained below, jack EC1 can be connected to a cable providing an input audio signal from an external conferencing system and jack EC2 can be connected to a cable providing an output mixed audio signal to that external conferencing system.

Located below jacks EC1 and EC2 is a region of connection panel 32 labeled "Headphone Monitor Mix Out." Contained in that region are jacks Hm1, Hm2, and Hm3. As explained below, jacks Hm1 through Hm3 can be connected to headphones so as to allow listen-only monitoring access to a mixed audio signal generated by device 10. Volume of the mixed audio signal output through jacks Hm1 through Hm3 can be adjusted by turning a control knob 36 labeled "Headphone Monitor Mix Volume." Knob 36 is mechanically coupled to a potentiometer on the underside of connection panel 32.

On the right side of connection panel 32 are two columns of headset regions labeled "Headset <#>," where "<#>" is an integer between 1 and 10. Each of these headset regions contains a microphone connection jack labeled "MIC In" and a headphones connection jack labeled "Headphones." A user of device 10 may connect his or her microphone to the microphone jack in one of the headset regions and connect his or her headphones to the headphones jack in that region so as to provide audio input using his or her microphone and receive a mixed audio signal via his or her headphones. As explained in more detail below, that mixed audio signal may contain conversation and/or other audio input from users connected through other headset region microphone jacks and/or from an external conferencing system. In some embodiments, the microphone connected to a microphone jack in one of the headset regions may be for a microphone of an aviation headset, and the headphones connected to the headphones jack in that headset region may be for the headphones of that aviation headset. One example of a type of aviation headset that may be used in connection with device 10 according to some embodiments is the Bose® A20® aviation headset available from Bose Corporation of Framingham, Mass., US.

To avoid obscuring FIG. 6, reference numbers and lead lines are only included in FIG. 6 for one microphone jack and headphones jack pair. Specifically, the microphone jack in the region labeled "Headset 5" is marked with reference number M5 and the headphones jack in that same region is marked with reference number H5. Reference numbers for headphones and microphone jacks in other regions, which reference numbers are discussed below in connection with FIG. 8, follow a similar convention. In particular, the microphone jack and headphones jack in the region labeled "Headset 1" are assigned respective reference numbers M1 and H1, the microphone jack and headphones jack in the region labeled "Headset 2" are assigned respective reference numbers M2 and H2, etc.

Also seen in FIG. 6 are an intake cooling fan 38 and an exhaust fan 37. Fans 37 and 38 penetrate cover plate 31. Air is drawn in through fan 38 to cool components within main body 13 and is exhausted through fan 37.

Figure 7:
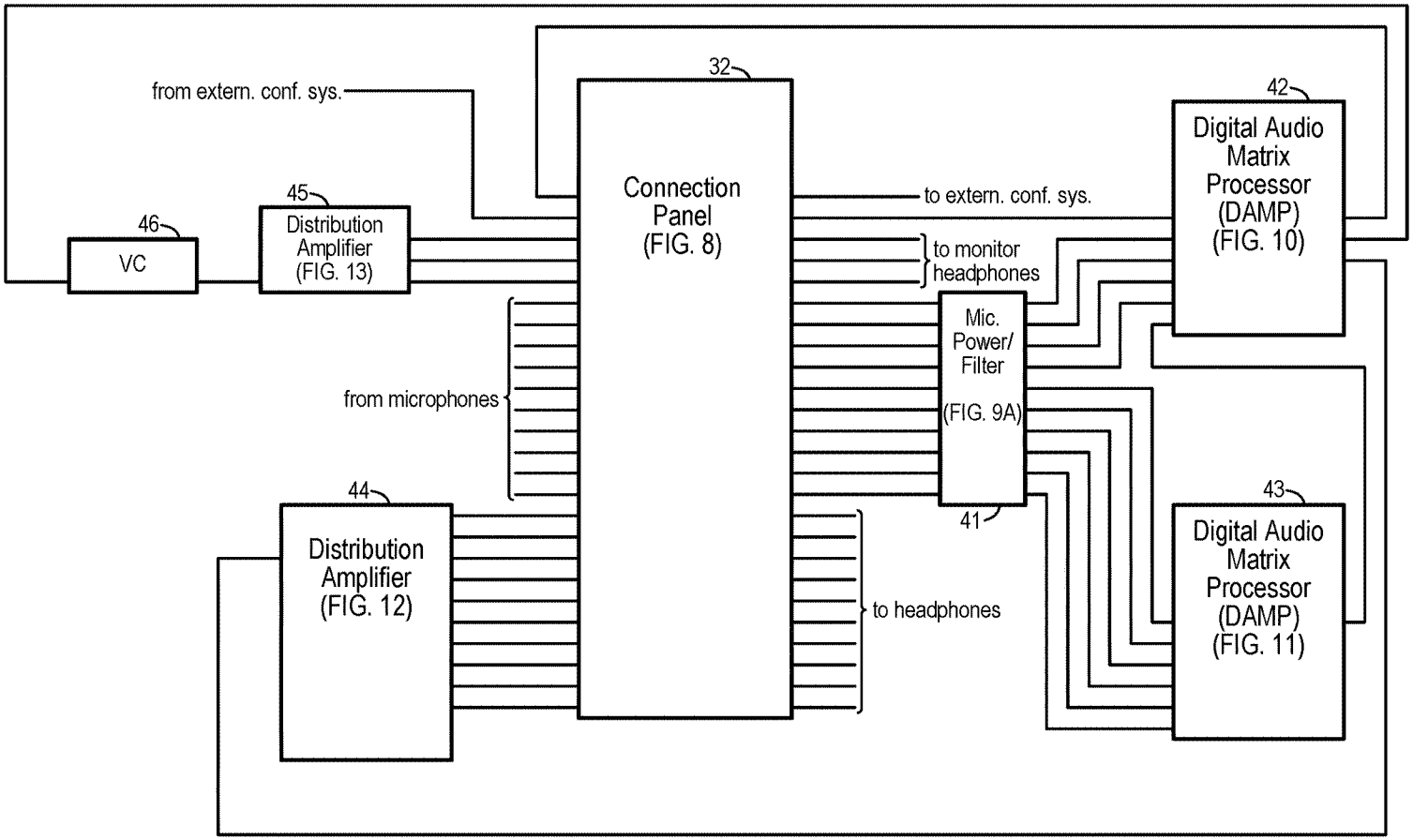
FIG. 7 is a block diagram showing components of the tactical audio distribution device of FIG. 1.

FIG. 7 is a block diagram showing connections between some components of device 10. Additional details of the connections are discussed below in connection with FIGS. 8-13. The components represented in FIG. 7 include control panel 32, microphone power and filter circuits (MPF) 41, a digital audio matrix processor (DAMP) 42, another second DAMP 43, a distribution amplifier 44, another distribution amplifier 45, and a volume control potentiometer 46.

Connection panel 32 provides a physical and electrical interface between device 10 and external components such as microphones, headphones, and an external conferencing system. As initially explained above, connection panel 32 includes multiple jacks by which microphones, headphones, and an external conferencing system may connect to device 10. An underside of connection panel 32 includes numerous signal connection points and wiring to electrically couple those signal connection points to various individual jacks. Those signal connection points are then electrically connected (e.g., by wires or other conductors) to one or more other components shown in FIG. 7. Those signal connection points may be implemented as posts to which one or more wires may be fastened, terminals into which mating terminals attached to wires or other conductors may be inserted, or other conventional device for forming an electrical connection.

Microphone power and filter circuits 41 provide power to microphones connected to microphone jacks M1 through M10. Circuits of MPF 41 also filter DC components of audio signals received from microphones and pass the AC components of those audio signals to one of DAMP 42 or DAMP 43.

Each of DAMP 42 and DAMP 43 is a multi-input, multi-output audio matrix mixer that accepts input audio signals, digitizes those audio signals, combines those audio signals to generate a mixed audio signal that aggregates input audio, converts the digital mixed audio signal to analog form, and outputs the analog form of the mixed audio signal. The mixed audio signal is generated according to configuration parameters that control internal processing by the DAMP for proper gain structure, equalization, and output volume. Those configuration parameters are input to the DAMP in a configuration file that contains instructions for all of the virtual routing and signal processing for all input and output channels of the DAMP. In some embodiments, each of DAMP 42 and DAMP 43 is a 6 input line, 4 output line audio matrix mixer with 24-bit/48 kHz analog-to-digital and digital-to-analog converters. One example of a device that may be used for DAMP 42 and for DAMP 43 is the digital matrix processor sold under the product name "DMP 64" by Extron Electronics of Anaheim, Calif., US.

DAMP 43 receives filtered audio signals from circuits 41 that correspond to inputs received from microphone jacks M5 through M10. DAMP 43 outputs a mixed intermediate audio signal based on those inputs. The mixed intermediate audio signal from DAMP 43 is received by DAMP 42 on one input. Another input of DAMP 42 receives an audio signal from an external conferencing system. The remaining inputs of DAMP 42 receive filtered audio signals from circuits 41 that correspond to inputs received from microphone jacks M1 through M4. DAMP 42 outputs a mixed audio signal based on inputs corresponding to microphone jacks M1 through M4, the external conferencing system input, and the input received from DAMP 43.

Distribution amplifier 44 receives a mixed audio signal output from DAMP 42. Distribution amplifier 44 amplifies that signal and outputs the amplified signal to headphones output signal connection points on connection panel 32. One example of a device that may be used for distribution amplifier 44 in some embodiments is the audio distribution amplifier sold under the product name "SADA-6" by FSR Inc. of Woodland Park, N.J., US.

The mixed audio signal output from DAMP 42 is also provided as an input to a volume control (VC) potentiometer 46. A volume-adjusted output of potentiometer 46 is provided as an input to distribution amplifier 45. Distribution amplifier 45 amplifies that signal and outputs the amplified signal to additional headphones output signal connection points on connection panel 32. One example of a device that may be used for distribution amplifier 45 in some embodiments is the audio distribution amplifier sold under the product name "MDA 3" by Extron Electronics.

Figure 8:
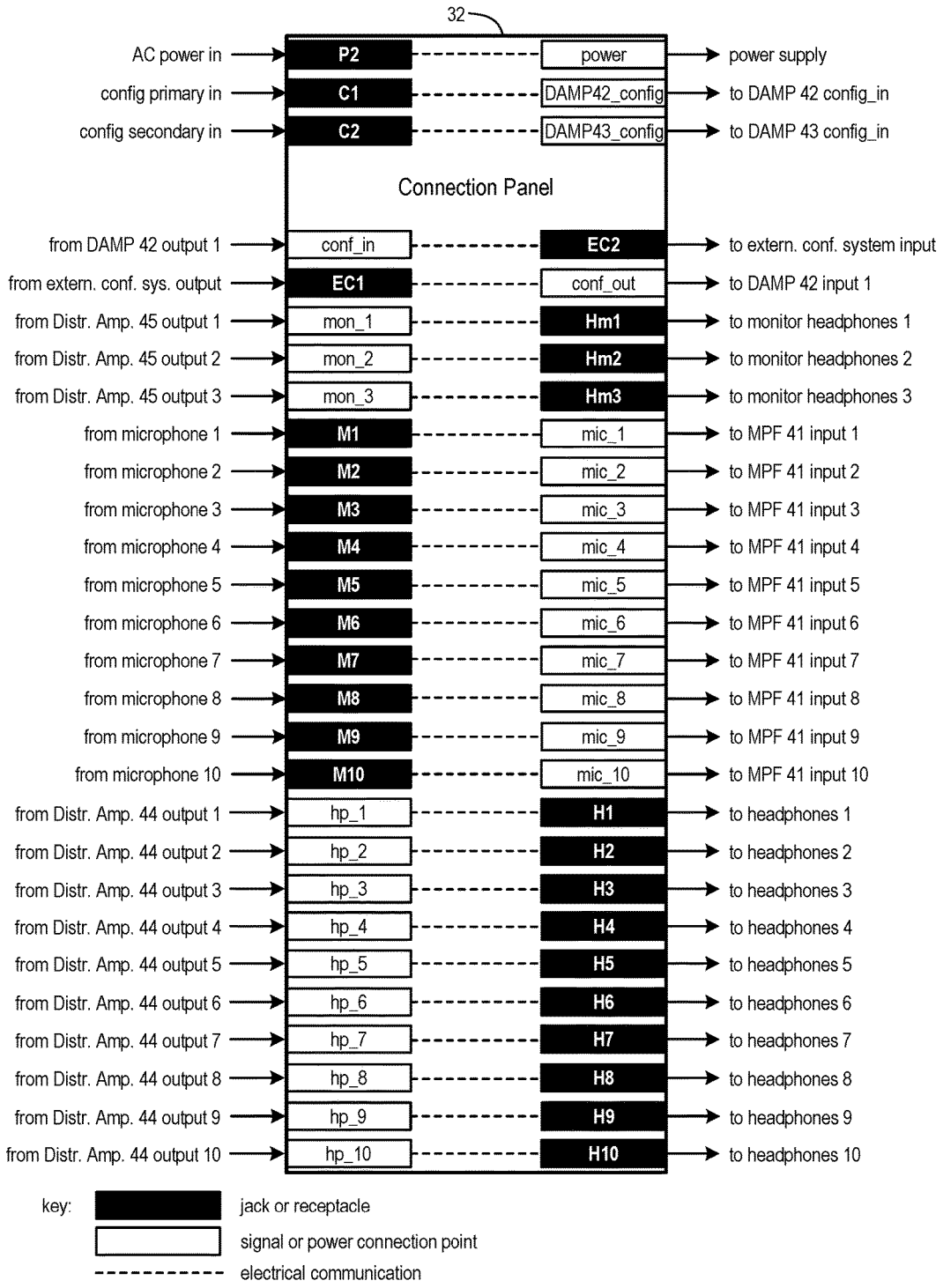
FIG. 8 is a diagram showing additional details of the connection panel from the block diagram of FIG. 7.

FIG. 8 is an enlarged block diagram of connection panel 32 showing additional details thereof. In FIG. 8, jacks and power receptacle P1 are shown as black boxes with white lettering. A power or signal connection point in electrical communication with a particular jack is shown on the same row in FIG. 8 as a white box with black lettering. A signal connection point may represent a single electrical circuit (e.g., a signal ground and a signal conductor for an audio signal) or multiple electrical circuits.

Beginning at the top of FIG. 8, receptacle P1 can be connected to a power cord and is configured to receive electrical power from an external power source. Receptacle P1 is in electrical communication with a power connection point labeled "power." The power connection point is in electrical communication with one or more power supplies within device 10.

Jack Co1 can be connected to an RJ-45 connector from a computer to receive configuration data ("config primary in") for DAMP 42. Jack Co1 is in electrical communication with a DAMP 42 configuration signal connection point DAMP 42_config. Connection point DAMP 42_config is in electrical communication with a configuration input to DAMP 42, as described below. Jack Co2 can be connected to an RJ-45 connector from a computer to receive configuration data ("config secondary in") for DAMP 43. Jack Co2 is in electrical communication with a DAMP 43 configuration signal connection point DAMP 43_config. Connection point DAMP 43_config is in electrical communication with a configuration input to DAMP 43, as also described below.

Signal connection point conf_in is in electrical communication with, and configured to receive a mixed audio signal from, an output of DAMP 42. Connection point conf_in is in electrical communication with jack EC2, which can be connected to an external conferencing system to transmit the mixed audio signal to that external conferencing system. Jack EC1, which can be connected to that external conferencing system to receive an audio input signal from that external conferencing system, is in electrical communication with signal connection point conf_out. Connection point conf_out is in electrical communication with, and configured to pass a received external conferencing system audio signal to, an input of DAMP 42.

Each of audio monitor signal connection points mon_1 through mon_3 is in electrical communication with a corresponding output of distribution amplifier 45 and configured to received a volume-adjusted and amplified mixed audio signal from that corresponding distribution amplifier 45 output. Connection points mon_1 through mon_3 are in electrical communication with jacks Hm1 through Hm3, respectively (i.e., connection point mon_1 is in electrical communication with jack Hm1, connection point mon_2 is in electrical communication with jack Hm2, and connection point mon_3 is in electrical communication with jack Hm3). Headphones connected to one of jacks Hm1 through Hm3 can thus receive mixed audio output from device 10.

Each of microphone jacks M1 through M10 can be connected to a mating plug of a microphone to receive a corresponding microphone audio signal. Jacks M1 through M10 are in electrical communication with microphone audio signal connection points mic_1 through mic_10, respectively. Connection points mic_1 through mic_10 are in electrical communication with MPF inputs 1 through 10, respectively.

Each of headphones signal connection points hp_1 through hp_10 is in electrical communication with a corresponding output of distribution amplifier 44 and is configured to receive an amplified mixed audio signal output from that corresponding distribution amplifier 44 output. Connection points hp_1 through hp_2 are in electrical communication with jacks H1 through H10, respectively. Headphones connected to one of jacks H1 through H10 can thus receive mixed audio output from device 10.

Figure 9A:
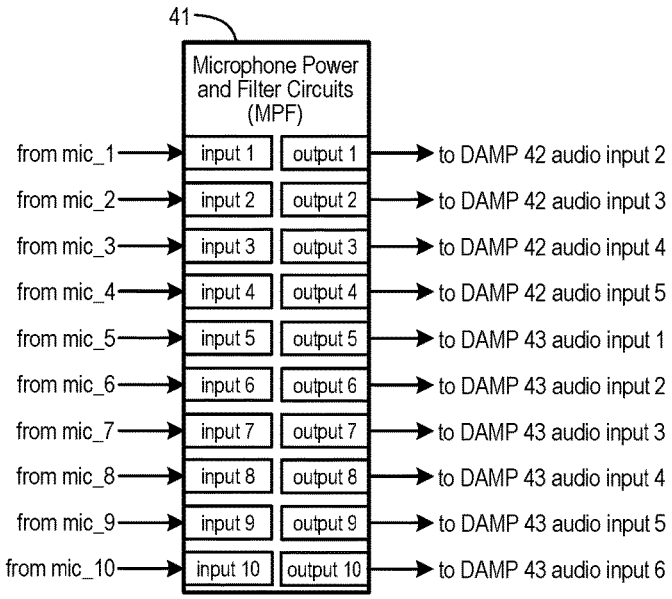
FIG. 9A is a diagram showing additional details of the microphone power and filter circuits from the block diagram of FIG. 7.

FIG. 9 is an enlarged block diagram of microphone power and filter circuits (MPF) 41. Each of MPF inputs 1 through 10 is in electrical communication with, and configured to receive a microphone audio signal present on, a respective one of connection points mic_1 through mic_10. Circuits of MPF 41 are configured to output microphone power on each of inputs 1 through 10, which power is returned through connection points mic_1 through mic_10 to jacks M1 through M10 and available to power a connected microphone. Circuits of MPF 41 also filter audio signals received over each of inputs 1 through 10 to remove DC components of those audio signals and provide filtered versions of those signals on outputs 1 through 10, respectively.

Figure 9B:
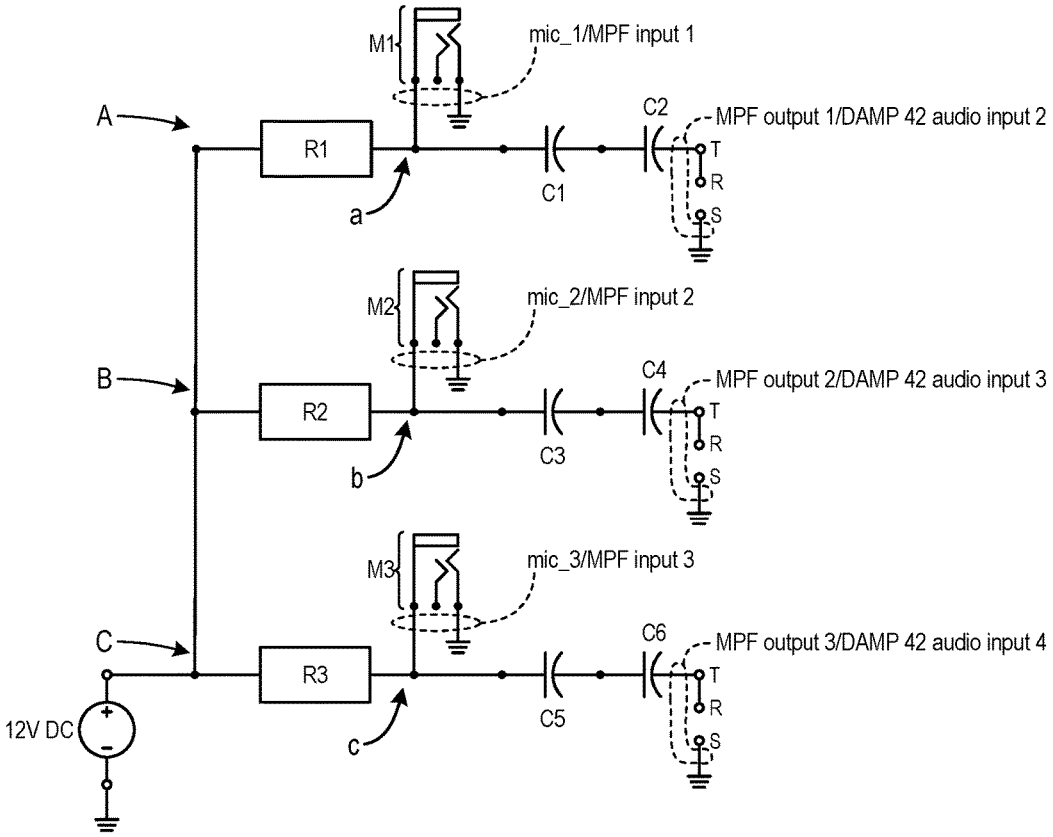
FIG. 9B is a schematic diagram of an exemplary sub-set of the microphone power and filter circuits represented by FIG. 9A.

FIG. 9B is a schematic diagram showing a portion of MPF 41 according to some embodiments. In some embodiments, MPF 41 is implemented as four separate circuit boards that each includes power and filter circuits corresponding to 3 of signal connection points mic_1 through mic_10. The schematic of FIG. 9B shows components of one such circuit board having circuits A, B, and C respectively serving connection points mic_1 through mic_3. Indicated in FIG. 9B are the portions of the schematic corresponding to MPF 41 inputs 1 through 3 (and connection points mic_1 through mic_3) and portions of the schematic corresponding to MPF 41 outputs 1 through 3 (and DAMP 42 inputs 2 through 4). MPF 41 includes three additional identical circuit boards serving connection points m_4 through m_10. A second circuit board includes three circuits identical to circuits A, B, and C of FIG. 9B respectively serving connection points m_4 through m_6. A third circuit board includes three circuits identical to circuits A, B, and C of FIG. 9B respectively serving connection points m_7 through m_9. A fourth circuit board includes three circuits identical to circuits A, B, and C of FIG. 9B, with one of those circuits serving connection point m_10 and the other two remaining unused.

Each of circuits A-C shown in FIG. 9B receives 12 volt DC power from a power supply within device 10. Each of those circuits includes a dropping resistor R1, R2, or R3 that may be, e.g., a 470 ohm ½ watt resistor. Each of those circuits also includes a pair of capacitors C1 and C2, C3 and C4, or C5 and C6. In some embodiments, each of capacitors C1 through C6 may have a capacitance of 22 microfarads (μF). At each of locations a, b, and c, exemplary current levels are between 0.011 amps and 0.016 amps and exemplary voltage levels are between 9.1 VDC and 9.4 VDC.

In some embodiments, each audio inputs of DAMP 42 and DAMP 43 may include three conductors, e.g., a tip (T) conductor, a ring (R) conductor, and a source (S) (or ground) conductor. In at least some such embodiments, DAMP 42 and DAMP 43 may be configurable to utilize the T, R, and S conductors so as to accept a balanced mono input, or may alternately be configurable to accept an unbalanced mono input in which the T and R conductors are connected. In the embodiment indicated in FIG. 9B, circuits of MPF 41 are configured to provide unbalanced mono inputs to DAMP 42 and DAMP 43.

Figure 10:
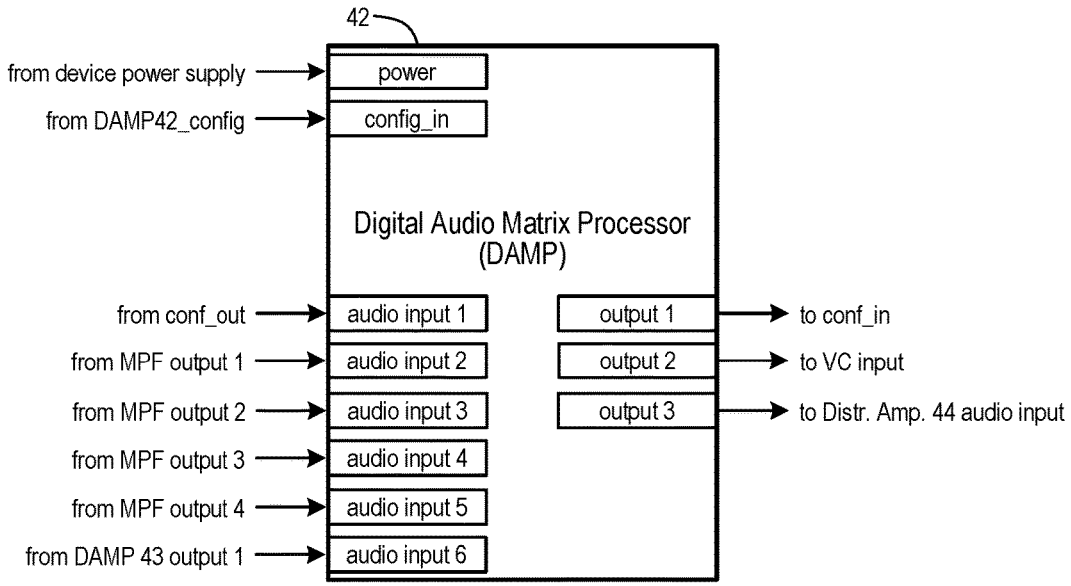
FIG. 10 is a diagram showing additional details of one of the digital audio matrix processors from the block diagram of FIG. 7.

FIG. 10 is an enlarged block diagram of DAMP 42. The power input of DAMP 42 receives 12 VDC power from a power supply of device 10. The config_in input of DAMP 42 is in electrical communication with, and configured to receive configuration instructions via, signal connection point DAMP 42_config. Audio input 1 of DAMP 42 is in electrical communication with, and configured to receive an audio signal present on, signal connection point conf_out. Audio inputs 2 through 4 of DAMP 42 are in electrical communication with, and configured to receive filtered audio signals present on, outputs 1 through 4, respectively, of MPF 41. Audio input 6 of DAMP 42 is in electrical communication with, and configured to receive a mixed intermediate audio signal present on, output 1 of DAMP 43. That mixed intermediate audio signal is discussed below. DAMP 42 executes software to digitize the audio signals received on audio inputs 1 through 6, combines those digitized audio signals to generate a mixed audio signal that aggregates audio components of all of the digitized audio signals, converts the digital mixed audio signal to analog form, and outputs the analog form of the mixed audio signal to each of outputs 1 through 3. The mixed audio signal is generated according to configuration parameters that control internal processing by DAMP 42 for proper gain structure, equalization, and output volume. In some embodiments, the mixed audio signal provided through each of DAMP 43 outputs 1 through 3 is an unbalanced mono signal.

Figure 11:
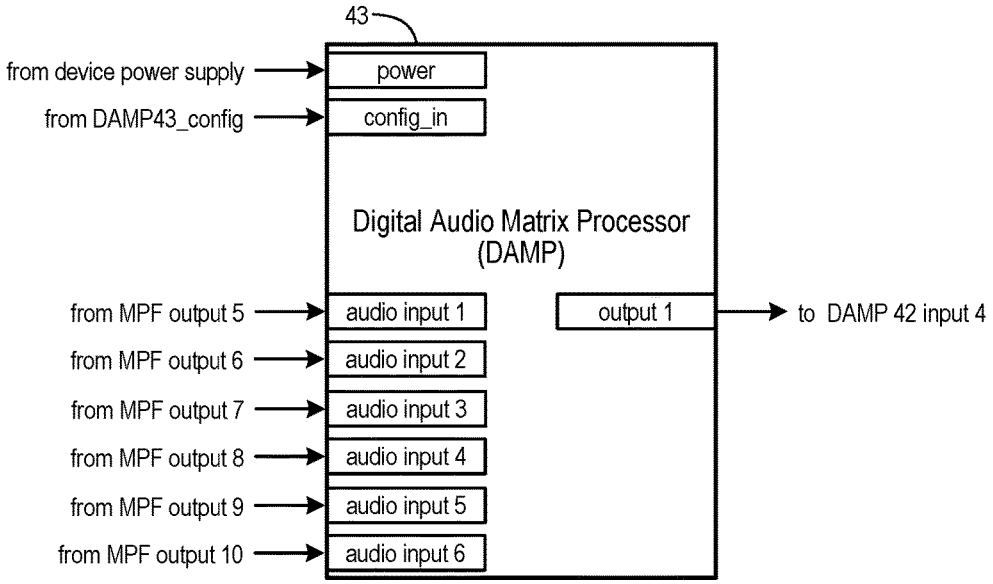
FIG. 11 is a diagram showing additional details of another of the digital audio matrix processors from the block diagram of FIG. 7.

FIG. 11 is an enlarged block diagram of DAMP 43. The power input of DAMP 43 receives 12 VDC power from a power supply of device 10. The config_in input of DAMP 43 is in electrical communication with, and configured to receive configuration instructions via, signal connection point DAMP 43_config. Audio inputs 1 through 6 of DAMP 43 are in electrical communication with, and configured to receive filtered audio signals present on, outputs 5 through 10, respectively, of MPF 41. DAMP 43 executes software to digitize the audio signals received on its audio inputs 1 through 6, combines those audio digitized audio signals to generate a mixed intermediate audio signal that aggregates audio components of all of the digitized audio signals, converts the digital mixed intermediate audio signal to analog form, and outputs the analog form of the mixed intermediate audio signal to output 1. The mixed intermediate audio signal is generated according to configuration parameters that control internal processing by DAMP 43 for proper gain structure, equalization, and output volume. In some embodiments, the mixed audio signal provided through DAMP 42 output 1 is an unbalanced mono signal.

In some embodiments, DAMP 42 and DAMP 43 may be configured to provide a high pass filter on the microphone inputs (audio inputs 2 through 5 of DAMP 42, audio inputs 1 through 6 of DAMP 43) at a cutoff frequency of 180 Hz with a 12 dB/octave slope to attenuate extraneous low-frequency content like mechanical rumble or vocal plosives, and to further provide a low pass filter on the microphone inputs at a cutoff frequency of 8000 Hz with a 12 dB/octave slope to eliminate unwanted bandwidth. DAMP 42 may be configured so that the input gain for the input signal of the external conferencing system (on audio input 1 of DAMP 42) and the input gain for mixed intermediate audio signal from DAMP 43 (on audio input 6 of DAMP 42) are adjusted to a point to reach unity gain. All input signals may be given a +2 dB boost at each of the cross points within the mixer gain of DAMP 42. The microphone mix out and monitor out signal outputs on DAMP 42 may be given a +11 dB gain at the post-mixer trim.

Figure 12:
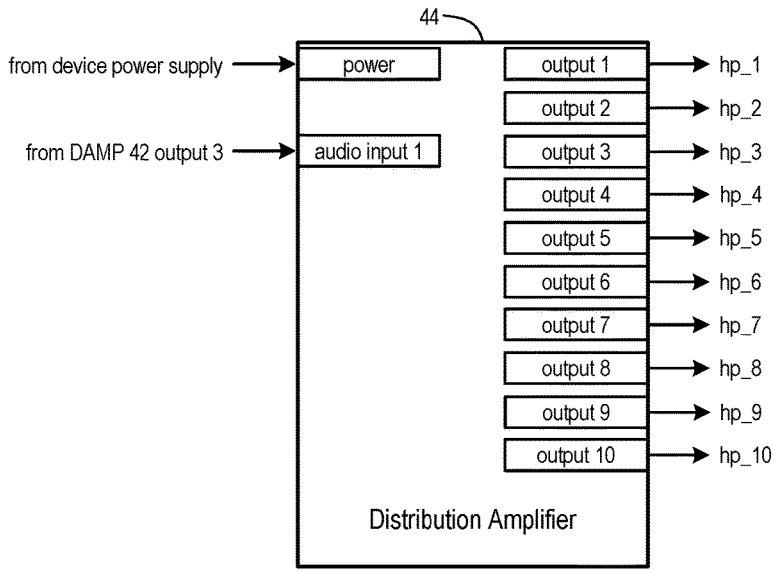
FIG. 12 is a diagram showing additional details of a first distribution amplifier from the block diagram of FIG. 7.

FIG. 12 is an enlarged block diagram of distribution amplifier 44. The power input of distribution amplifier 44 receives 12 VDC power from a power supply of device 10. The audio input of distribution amplifier 44 is in electrical communication with, and configured to received a mixed audio signal present on, output 3 of DAMP 42. Amplifier 44 amplifies the mixed audio signal received on its input and provides the amplified mixed audio signal on each of outputs 1 through 10. Outputs 1 through 10 of amplifier 44 are in electrical communication with, and configured to provide the amplified mixed audio signal to, headphones signal connection points hp_1 through hp_10, respectively. Each of the amplified mixed audio signals output from distribution amplifier 44 may be an unbalanced mono signal.

Figure 13:
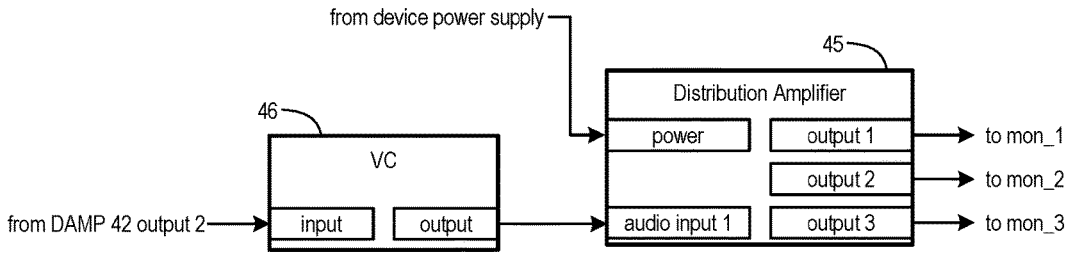
FIG. 13 is a diagram showing additional details of a volume control potentiometer and a second distribution amplifier from the block diagram of FIG. 7.

FIG. 13 is an enlarged block diagram of volume control potentiometer 46 and distribution amplifier 45. The power input of distribution amplifier 45 receives 12 VDC power from a power supply of device 10. The input of potentiometer 46 is in electrical communication with, and configured to receive a mixed audio signal present on, output 2 of DAMP 42. On its output, potentiometer 46 provides a volume-adjusted version of that mixed audio signal. The audio input of distribution amplifier 45 is in electrical communication with the output of volume control potentiometer 46. Amplifier 45 amplifies the volume-adjusted version of the mixed audio signal received on its input and provides the amplified volume-adjusted mixed audio signal on each of outputs 1 through 3 as an unbalanced mono signal. Outputs 1 through 3 of amplifier 45 are in electrical communication with, and configured to provide the amplified volume-adjusted mixed audio signal to, headphones signal connection points mon_1 through mon_3, respectively.

Figure 14A:
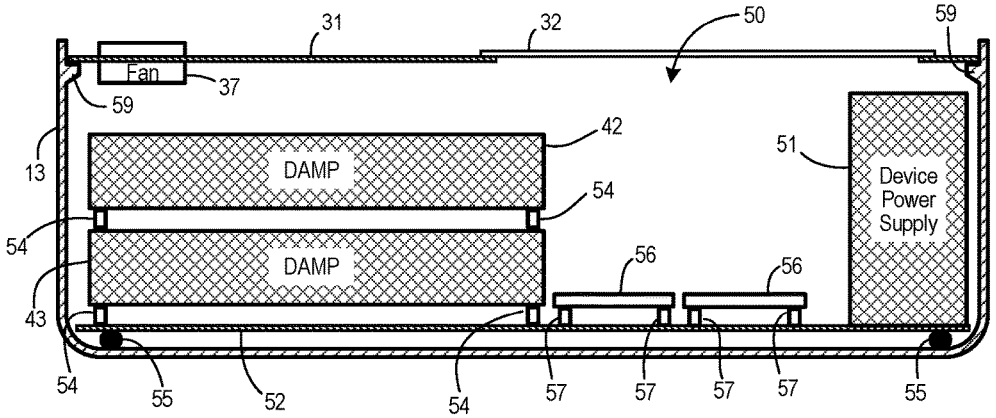
FIG. 14A is a partially schematic cross-sectional view taken along the sectioning plane indicated in FIG. 6 by arrows 14A-14A.
Figure 14B:
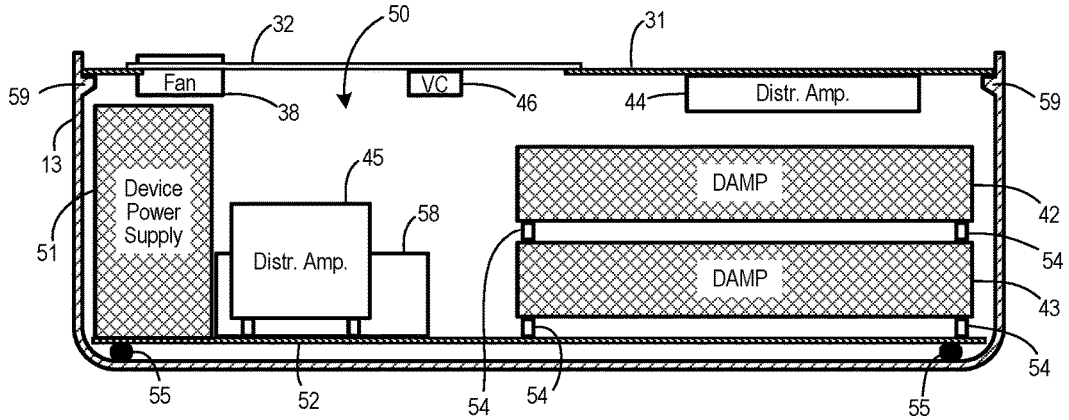
FIG. 14B is a partially schematic cross-sectional view taken along the sectioning plane indicated in FIG. 6 by arrows 14B-14B.
Figure 14C:
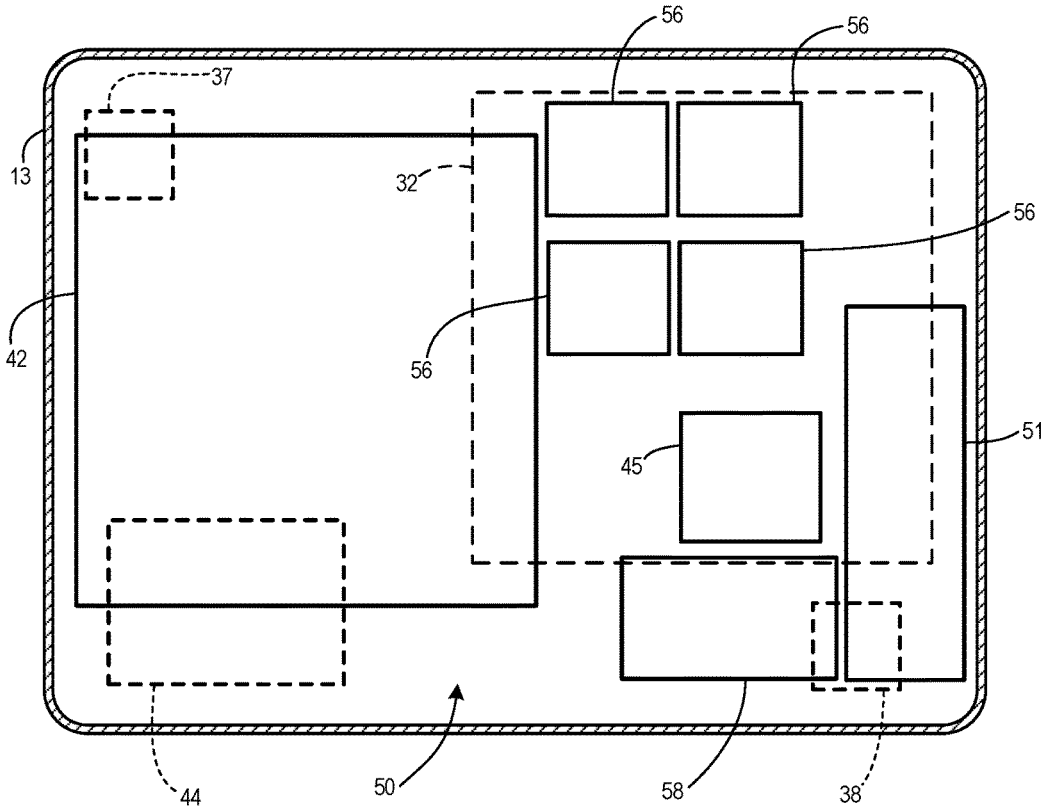
FIG. 14C is a partially schematic cross-sectional view taken along the sectioning plane indicated in FIG. 1 by arrows 14C-14C.

FIG. 14A is a partially schematic cross-sectional view taken along the sectioning plane indicated in FIG. 6 by arrows 14A. FIG. 14B is a partially schematic cross-sectional view taken along the sectioning plane indicated in FIG. 6 by arrows 14B. FIG. 14C is a partially schematic cross-sectional view taken from along the sectioning plane indicated in FIG. 1 by arrows 14C. FIGS. 14A through 14C show placement of various components of device 10 according to some embodiments. For simplicity, some components are represented in FIGS. 14A through 14C as simple boxes having sizes approximating sizes of those components relative to each other and relative to main body 13 of housing 12. All components are not shown. In FIG. 14A, which looks toward the rear of device 10, and FIG. 14C, in which the front of device 10 is at the bottom of the drawing, the left side of device 10 is on the right side of the drawing. In FIG. 14B, which looks toward the front of device 10, the left side of the device is on the left side of the drawing. Double cross-hatching is used for certain components in FIGS. 14A and 14B to indicate that the sectioning planes of those figures pass through those components.

A device main power supply 51 is located on a left side of an interior compartment 50 of main body 13 and is secured to a base plate 52. Main power supply 51 receives AC power from the power connection point of control panel 32 and provides 12 VDC power to DAMP 42, DAMP 43, distribution amplifiers 44 and 45, MPF 41, and other components of device 10. DAMP 42 and DAMP 43 are stacked atop one another and located on the right side of compartment 50. DAMP 43 is secured to base plate 52 using risers 54 to create ventilation space under DAMP 43. DAMP 42 is secured to the top of DAMP 43 using risers 54 to create ventilation space between DAMP 42 and DAMP 43.

Situated between power supply 51 and DAMPs 42 and 43 at the bottom rear of compartment 50 are circuit boards 56 of MPF 41. Two of the four circuit boards 56 of MPF 41 are visible in FIG. 14A, with the other two circuit boards of MPF 41 being behind the two boards 56 that are visible in FIG. 14A. Each of circuit boards 56 includes components for three circuits as shown in FIG. 9B. Circuit boards 56 are secured to base plate 52 using risers 57 to create ventilation space under circuit boards 56. Situated between power supply 51 and DAMPs 42 and 43 at the bottom front of compartment 50 are distribution amplifier 45 and a separate power supply 58 for fans 37 and 38. Amplifier 45 is connected to base plate 52 with risers. Although FIGS. 14A and 14B show power supplies 51 and 58 connected to base plate 52 without risers, risers could also be used to create space under power supplies 51 and 58.

Base plate 52 is secured to the bottom of main body 13 using vibration isolation mounts 55. Each of mounts 55 may comprise hardened rubber with opposing threaded receptacles.

Distribution amplifier 44 is attached to the underside of cover plate 31. Volume control potentiometer 46 is attached to the underside of connection panel 32 in a region under knob 36. For convenience, knob 36, jacks, and other elements attached to connection panel 32 are omitted from FIGS. 14A through 14C.

Cover plate 31 is fastened to main body 13 using screws that secure an edge of plate 31 to a ledge 59 near the top of compartment 50. Fans 37 and 38 penetrate and are secured to cover plate 31. In the embodiment shown in FIGS. 14A through 14C, connection panel 32 is a separate panel that is fastened in place (e.g., by rivets) over an opening formed in cover plate 31. In other embodiments, a connection panel may be an integral part of a cover plate or may be coupled to a tactical audio device in another manner.

In operation, device 10 may be first connected to a source of electrical power by plugging a power cord terminal into receptacle P1. Individuals having a microphone and headphones may connect to device 10 by selecting an unused one of the headset regions of connection panel 32, inserting the terminal from that individual's microphone cable into the microphone jack of the selected headset region (e.g., jack M5 of the Headset 5 region), and inserting the terminal from that individual's headphones cable into the headphones jack of the selected headset region (e.g., jack H5 of the Headset 5 region). Up to nine other individuals may similarly connect a microphone cable and a headphones cable to jacks in one of the other headset regions. The individuals who have connected microphones and headphones to device 10 may then converse, with speech input to some or all microphones being simultaneously conveyed to all headphones.

If desired, an audio output from an external conferencing system may be connected to device 10 by inserting a terminal of an output cable of that external conferencing system into jack EC1. An audio input from device 10 to the external conferencing system may be provided by inserting a terminal of an input cable of that external conferencing system into jack EC2. Once the external conferencing system is connected, conversation and other sounds from the external conferencing system will be mixed with conversation and other sounds from microphones connected through one or more of jacks M1 through M10 and become part of the audio signal provided to headphones (and back to the external conferencing system).

The external conferencing system providing audio input to device 10 and receiving audio output from device 10 may be, e.g., a video teleconferencing system. The external conferencing system might alternatively be another tactical audio distribution device 10. In such a case, the EC1 jack of one device 10 may be connected to the EC2 jack of the other device 10, and vice versa.

Up to three headphones may be connected to jacks Hm1 through Hm3 to provide listen-only monitoring of the conversation and other sounds input through connected microphones or received through jack EC1.

The above description and drawings provide details of certain embodiments. Other embodiments may include different components and/or configurations. In some embodiments, for example, each of one or more microphone jack and headphones jack pairs could be replaced with a single jack that provides connectivity for a microphone and for headphones. As but another example, a signal or power connection point may be part of a jack or receptacle. As yet another example, the placement of components shown in FIGS. 14A through 14C could be varied. As a further example, the positions, labeling, quantity and type of jacks and other elements of a connection panel could vary from that shown in FIG. 6.

As used herein, including the claims, a signal based on another signal may be that other signal, or it may be a signal that was derived, at least in part, by filtering, amplifying, adding to, subtracting from, and/or otherwise modifying that other signal. As used herein, including the claims, two elements are in electrical communication if a change in voltage and/or current at one of the two elements causes a change in voltage and/or current at the other of the two elements.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, subcombinations and permutations of features from herein-described embodiments, whether or not such combination, subcombination, or permutation is expressly recited above or below, are the within the scope of the invention.

The invention claimed is:

1. A tactical audio distribution device, comprising:

a housing comprising a main body, a lid, and a handle, wherein the lid is configured for non-destructive complete removable from, and securing to, the main body, and wherein the handle is secured to an exterior of the main body;

a cover plate secured to the main body;

a connection panel, wherein the connection panel is fastened to or an integral part of the cover plate, wherein the connection panel comprises a connection panel exterior side that is exposed when the lid is removed from the main body and that is enclosed within the housing when the lid is secured to the main body, and wherein the connection panel, cover plate, and main body define a main body compartment;

a first plurality of connection jacks located on the connection panel exterior side;

a second plurality of microphone input signal connection points contained in the main body compartment and in electrical communication with at least a portion of the connection jacks, wherein the second plurality is at least five;

microphone power and filter circuits contained in main body compartment, wherein the microphone power and filter circuits are configured to output microphone electrical power through the at least a portion of the connection jacks, to receive first signals, to create second signals by filtering DC components of the first signals, and to output the second signals, and wherein each of the first signals is based on an audio input signal present on one of the microphone input signal connection points;

a first digital audio matrix processor contained in the main body compartment, wherein the first digital audio matrix processor is configured to receive a first set of third signals based on a first portion of the second signals and corresponding to a subset of the first signals, to combine the first set of third signals into a mixed intermediate audio signal aggregating audio components of the first set of third signals, and to output the mixed intermediate audio signal;

a second digital audio matrix processor contained in the main body compartment, wherein the second digital audio matrix processor is configured to receive a second set of third signals based on a second portion of the second signals and corresponding to the remaining first signals, to receive the mixed intermediate audio signal, to combine the second set of third signals and the mixed intermediate audio signal into a mixed audio signal aggregating audio components of the second set of third signals and the mixed intermediate audio signal; and a third plurality of headphones output signal connection points contained in the main body compartment and in electrical communication with at least some of the connection jacks, wherein the headphones output signal connection points are configured to receive signals based on the mixed audio signal, and wherein the third plurality is at least five.

2. The tactical audio distribution device of claim 1, wherein the first plurality of jacks comprises a set of microphone jacks and separate set of headphones jacks, wherein the at least a portion of the connection jacks in electrical communication with the microphone input signal connection points are the microphone jacks of the set of microphone jacks, and wherein the at least some of the connection jacks in electrical communication with the headphones output signal connection points are the headphones jacks of the separate set of headphones jacks.

3. The tactical audio distribution device of claim 1, wherein the first digital audio matrix processor, the second digital audio matrix processor, and the microphone power and filter circuits are coupled to a base plate, and wherein the base plate is secured to the main body, in a bottom of the main body compartment, by vibration isolation mounts.

4. The tactical audio distribution device of claim 1, wherein the second plurality is at least ten and the third plurality is at least ten.

5. The tactical audio distribution device of claim 1, wherein the first plurality is greater than the second plurality.

6. The tactical audio distribution device of claim 1, further comprising:

at least one external conferencing system connection jack located on the connection panel exterior side;

an external conferencing system input signal connection point in electrical communication with at least a portion of the at least one external conferencing system connection jack; and an external conferencing system output signal connection point in electrical communication with at least part of the at least one external conferencing system connection jack, and wherein the second digital audio matrix processor is configured to receive a fourth signal based on an audio signal present on the external conferencing system input signal connection point and to combine the fourth signal, the second set of third signals, and the mixed intermediate audio signal into the mixed audio signal aggregating audio components of all of the third signals and of the fourth signal.

7. The tactical audio distribution device of claim 6, wherein the first plurality is at least ten and the second plurality is at least ten.

8. The tactical audio distribution device of claim 7, wherein the first digital audio matrix processor, the second digital audio matrix processor, and the microphone power and filter circuits are coupled to a base plate, and wherein the base plate is secured to the main body, in a bottom of the main body compartment, by vibration isolation mounts.

9. The tactical audio distribution device of claim 1, wherein the microphone power and filter circuits comprise a separate microphone power and filter circuit corresponding to each of the microphone input signal connection points.

10. The tactical audio distribution device of claim 9, further comprising:

at least one external conferencing system connection jack located on the connection panel exterior side;

an external conferencing system input signal connection point in electrical communication with at least a portion of the at least one external conferencing system connection jack; and an external conferencing system output signal connection point in electrical communication with at least part of the at least one external conferencing system connection jack, and wherein the second digital audio matrix processor includes an additional audio input in electrical communication with the external conferencing system input signal connection point, the second digital audio matrix processor includes an output in electrical communication with the external conferencing system output signal connection point, and the second digital audio matrix processor is configured to output the mixed audio signal on the output in electrical communication with the external conferencing system output signal connection point.

11. The tactical audio distribution device of claim 1, wherein the connection panel, the cover plate, and an exterior of the main body lack configuration controls for the first digital audio matrix processor and lack configuration controls for the second digital audio matrix processor.

12. The tactical audio distribution device of claim 1, further comprising first and second configuration jacks located on the connection panel exterior side, wherein the first digital audio matrix processor is configured to receive configuration instructions via the first configuration jack and the second digital audio matrix processor is configured to receive configuration instructions via the second configuration jack.

13. The tactical audio distribution device of claim 12, wherein the connection panel, the cover plate, and an exterior of the main body lack configuration controls for the first digital audio matrix processor and lack configuration controls for the second digital audio matrix processor.

14. The tactical audio distribution device of claim 1, and wherein each of the first digital audio matrix processor and the second digital audio matrix processor is configured to apply a high pass filter comprising a 180 Hz cutoff frequency and 12 dB/octave slope and a low pass filter comprising an 8000 Hz cutoff frequency and 12 dB/octave slope to the third signals.

15. The tactical audio distribution device of claim 14, wherein the connection panel, the cover plate, and an exterior of the main body lack configuration controls for the first digital audio matrix processor and lack configuration controls for the second digital audio matrix processor.

* * * * *